US005601196A

United States Patent [19]

Heer et al.

[11] Patent Number: 5,601,196

[45] Date of Patent: Feb. 11, 1997

[54] DEVICE FOR SUSPENDING AN ELONGATED OBJECT

[75] Inventors: Alfred Heer, Tödistr. 44, 8344 Bäretswil; Alfred Dubach, Bäretswil, both of Switzerland

[73] Assignee: Alfred Heer, Baretswil, Switzerland

[21] Appl. No.: 379,454

[22] PCT Filed: May 11, 1994

[86] PCT No.: PCT/CH94/00087

§ 371 Date: Jan. 27, 1995

§ 102(e) Date: Jan. 27, 1995

[87] PCT Pub. No.: WO94/27487

PCT Pub. Date: Dec. 8, 1994

[30] Foreign Application Priority Data

May 27, 1993 [CH] Switzerland ..... 1600/93

[51] Int. Cl.[6] ..... A47B 81/02

[52] U.S. Cl. ..... 211/65; 211/66; 211/89; 211/94; 248/113; 248/316.2; 248/316.3; 248/316.5

[58] Field of Search ..... 248/316.1, 316.2, 248/316.3, 316.5, 113; 211/65, 66, 89, 94

[56] References Cited

U.S. PATENT DOCUMENTS

| | | | |
|---|---|---|---|
| 1,306,585 | 6/1919 | Droege et al. . | |
| 1,609,666 | 12/1926 | Settevig | 248/316.3 X |
| 1,958,772 | 5/1934 | Stewart | 248/316.3 X |
| 2,370,876 | 3/1945 | Richardson | 248/316.3 X |
| 2,661,920 | 12/1953 | Gochenour | 211/65 X |
| 2,683,891 | 7/1954 | Rosenbaum | 211/94 X |
| 2,869,209 | 1/1959 | Kautzky | 248/113 X |
| 3,161,393 | 12/1964 | Swanson | 248/316.3 X |
| 4,591,058 | 5/1986 | Amstutz et al. | 211/94 |
| 4,678,151 | 7/1987 | Radek | 211/94 X |
| 4,763,797 | 8/1988 | Egan | 211/89 X |
| 4,798,298 | 1/1989 | Ursetta | 211/89 X |
| 4,988,007 | 1/1991 | Chiarot | 211/94 X |
| 5,110,080 | 5/1992 | Rieman | 211/94 X |
| 5,183,164 | 2/1993 | Heinzle | 248/316.3 X |
| 5,303,831 | 4/1994 | Miller | 211/66 |
| 5,417,335 | 5/1995 | White | 211/89 X |
| 5,465,935 | 11/1995 | Wilbs | 248/316.3 |

FOREIGN PATENT DOCUMENTS

| | | | |
|---|---|---|---|
| 969889 | 6/1975 | Canada | 211/65 |
| 0180884 | 5/1986 | European Pat. Off. . | |
| 0507721 | 10/1992 | European Pat. Off. . | |
| 500964 | 3/1920 | France | 248/316.3 |
| 504185 | 7/1930 | Germany | 211/65 |
| 3818031 | 11/1989 | Germany . | |
| 4106351 | 9/1992 | Germany | 211/94 |
| 47092 | 3/1909 | Switzerland | 211/65 |
| 365501 | 11/1962 | Switzerland | 211/65 |
| 619125 | 9/1980 | Switzerland | 211/94 |
| 641003 | 8/1950 | United Kingdom | 211/65 |

*Primary Examiner*—Alvin C. Chin-Shue
*Assistant Examiner*—Michael J. Turgeon
*Attorney, Agent, or Firm*—Breiner & Breiner

[57] ABSTRACT

The invention concerns a device comprising at least one clamp (1) to hang up a substantially elongated object. The clamp is displaceable toward a wall or another clamp (1) in order that the object be held in-between on account of its own weight. The minimum of one clamp furthermore comprises two vertically spaced rest segments (3, 5) and/or at least one planar rest zone in order to engage one side of the object being clamped or suspended and to drive this object against the wall or the other clamp.

17 Claims, 5 Drawing Sheets

20a
20b
20c
20d
16
23
1
3
5
11
13
15
17
29
31

FIG. 16
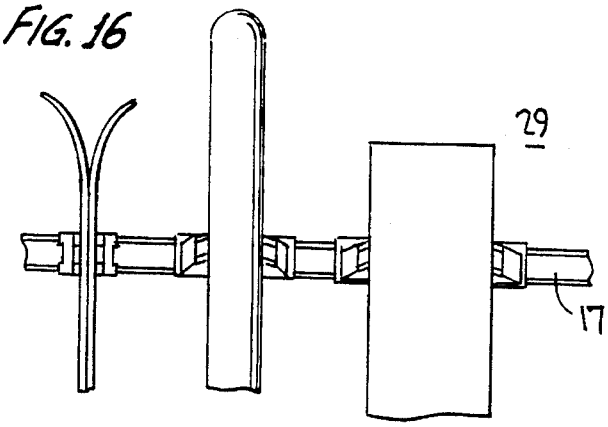
FIG. 17b
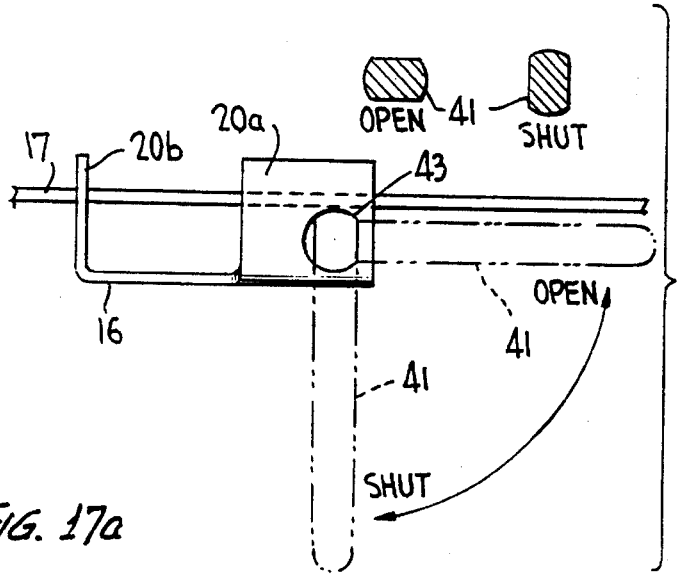
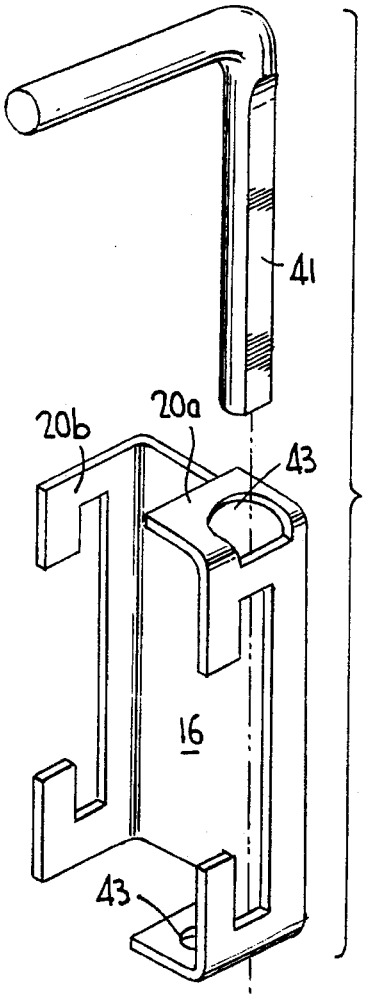
FIG. 17a

DEVICE FOR SUSPENDING AN ELONGATED OBJECT

The present invention concerns a device for suspending in an orderly manner, in particular, a substantially elongated object. The device comprises at least one clamp pointing towards a wall or toward another clamp for the purpose of wedging the object in-between by the object's own weight. The invention further concerns a system comprising at least one device to orderly suspend substantially elongated objects of different widths or thicknesses.

A number of devices and means are known to suspend in an orderly manner tools, household implements, hobby and gardening tools, skis, snowboards and the like. Illustratively, European Patent Document No. A 507,721 describes a clamp receiving an object forced into it. However, such a clamp has the drawback that only objects of a particular size, i.e., objects evincing particular stem-, handle- or stick-diameters, can be received.

Clamps are proposed in U.S. Pat. No. 4,170,333 and European Patent No. 180,884 for orderly mounting work implements. These clamps are based on the principle of gradually constricting horizontal cross-sections. In both devices, the object is inserted into a clamp-like structure, the horizontal cross-section at insertion being comparatively large. By letting go of the implement to be suspended, the clamp also is pivoted downward and the horizontal cross-section thereby reduced resulting in the implement being clamped in place. Again, the drawback incurred is in that these clamps are applicable only to implements of particular sizes, i.e., of particular cross-sections, and moreover the implements preferably should evince a round stem. The clamps incur a further drawback in that when let go, the implement does not hang vertically, but illustratively is pressed in its lower region against a wall at its back. Such clamps are unsuitable, for example, to hang up skis.

Again, U.S. Pat. No. 4,852,747 describes a holder achieving a clamping effect by the own weight of an object between an obliquely displaceable arm and a wall. The clamping arm or roller is obliquely displaceable downward and will press, for example, the skis when let go against a wall. However, once more a drawback is incurred in that the clamping effect of the downward pointing clamping roller is insufficient if the objects are fairly heavy since, as a result, the object will slip between the arm and the wall.

Lastly, German Offenlegungsschrift No. 38 18 031 discloses a tool holding system wherein clamping is achieved upon letting the tools go between two displaceable cylindrical bodies connected in rotational manner by two gear segments. This system entails the drawback that when the two clamping rollers are not aligned precisely horizontally to each other, the object clamped between them will tip, i.e., will hang obliquely. In this case, there is the danger again that the object will not be properly held and will slip.

Accordingly, one of the objects of the present invention is a holder to orderly suspend substantially elongated objects, such as tools, gardening implements, skis and the like, the holder making possible reliable, simple and tipping-free mounting of an object.

Another object of the invention is to orderly arrange objects of different widths or thicknesses in such a holder.

This problem is solved by the invention.

To neatly suspend in particular a substantially elongated object, such as a tool, a gardening or household implement, skis or the like, the invention provides a device comprising at least one clamp displaceable toward an opposite wall or toward another clamp for the purpose of holding the object, such as a tool or the like, in-between in a clamping manner by means of its own weight. It is essential in this respect that the minimum of one clamp comprise at least two rest segments spaced apart from each other in the vertical direction and/or at least one planar rest zone in order to engage one object side when clamping, i.e., in a suspended mounted state, and to force the object against the other wall or toward the other clamp.

In one embodiment, the minimum of one clamp is mounted in an essentially pivotable manner relative to the wall or the other clamp, or it is mounted on a planar component such as a base plate.

The clamp is mounted in a pivotable manner in such a way that at least two segments, or the planar zone, are pivotable about two shafts, i.e., each segment about one shaft or the zone in at least a nearly parallelogrammic manner about at least two shafts, whereby the displacement toward the wall or the other clamp is an arcuate downward motion clamping the object.

Preferably, the minimum of one clamp assumes the shape of a jaw, the segments or their connecting line of the connecting surface being subtended by the two segments or the planar zone forming the jaw being essentially parallel to the wall or to the further clamp or to the segments or surfaces present at the other clamp.

The segments or the planar zone implementing the clamping proper evince an extension which is substantially perpendicular to the planar component, such as the base plate.

Preferably, the other clamp comprises at least one point-like, longitudinally extended or surface rest. The object to be clamped is driven by the first clamp toward the rest.

In a preferred embodiment, one clamp, i.e., the clamping jaw, assumes the form of a parallelogram and is rigidly affixed by one side to the planar component, such as the base plate, and by its opposite side is pivotable laterally toward the wall or the other clamp for the purpose of clamping the object.

In order to achieve this pivotability, the opposite side can either pivotably rest on pivot shafts mounted on one side, or the clamping jaw can be made at least in part of a flexible or elastic or rubber material in order to endow the opposite side with lateral pivotability. Such flexible or elastic materials on one hand can be sheet metal or polymers, such as commercial softened, flexibilized or plasticized synthetics, or on the other hand elastomers or rubber, namely such substances as are conventionally used in making such implements. It is essential that such polymers or plastics are sufficiently flexible to also effectively clamp fairly heavy objects when using such clamping jaws without damaging the jaws. Illustrative materials are thermoplastic polyesters, polyamides, polyethylenes, PVCs, and the like.

Obviously, the displaceability of the opposite side also can be achieved by mechanic design features, for example by selecting thin-walled end zones at the other side in order to impart some flexibility to the clamping jaw in the zones.

In another embodiment achieving high clamping-jaw flexibility, the freely displaceable side of the parallelogrammic clamping-jaw is absent in order that thereby a nearly U-shaped clamp open at the end side is formed. This clamp comprises two terminal, mutually parallel edge-shaped or strip-shaped segments running substantially perpendicular to the planar component, such as a base plate.

These edge-shaped segments can flare in the upward direction to form thereby walls shaped like a clamping jaw. The two walls are substantially vertically one above the other in a non-clamping state. Moreover, these edge-shaped segments can be clad with a rubber substance, or a lip-fitted cylindrical body made of rubber or elastomer can be slipped on the edges to improve clamping when an object is being clamped.

The segments or the planar zone of the clamping jaws can be roughened or coated with a material increasing the sliding friction of the object to be clamped on the segments or planar zone.

In a further preferred embodiment of the clamp, the other clamp is substantially surface-symmetrical relative to the first and opposite clamp, and the two clamps are mutually pivotable. The above cited approximate surface of symmetry between the two clamps is formed by the object to be clamped, for example by a pair of skis. On account of this surface of symmetry of the two clamps, the object to be clamped is always clamped between the two mutually symmetrically arrayed segments, i.e., the two mutually symmetrical surfaces. In the process of clamping, first the mounted object, such as a garden implement or a pair of skis, is displaced upward between the two clamps which thereby are forced apart. Next the object is let go, i.e., it is left to hang, so that as a result of the object's weight, the two clamps, for example the two jaws, are driven toward one another to hold the object in place. Because the two clamps evince mutually opposite clamping segments, or each a planar clamping zone, the object to be hung up is prevented from tipping in the process. The large rest surface moreover assures that even heavier weight objects are reliably held.

To assure also the proper suspension of objects of substantial weight, such as iron bars and the like, using the clamps of the invention, illustratively, several clamps can be arrayed vertically opposite a wall or opposite a preferably similar number of further clamps in order to hold the objects between this plurality of clamps.

Preferred variations of embodiments of the device of the invention, i.e., of clamping jaws, are also defined.

Preferably, the clamps of the invention are mounted on a rail-fitted base plate along which are provided detents pawls. Clamps, such as jaws, are longitudinally displaceable along the rail and are able to be snapped in position at the detents pawls. This longitudinal displaceability of the individual clamps, for example jaws, allows the mounting of tools, implements or sports equipment of different thicknesses and widths. Illustratively, the longitudinally displaceable clamps also allow mounting of snowboards on a ski "rake" by pulling the clamps apart an appropriate distance. Even household or gardening implements of different widths and thicknesses are advantageously mounted on holding devices of the described kind.

in another embodiment, the clamps are mounted on guide plates fitted with clamps or holders in order that the guide plates together with the clamps can be affixed to rail-fitted base plates. These clamps or holders are designed in such a manner so as to allow being continuously displaceable along the rail.

Preferred embodiments of such devices for suspending objects of substantial length and with different thicknesses or dimensions using the clamps of the invention are described.

The invention is elucidated below in an illustrative manner in relation to the attached figures.

FIG. 1 is a view from the front and top of a clamp of the invention comprising a clamping jaw pivotable toward a wall.

FIG. 2 again is a schematic view from the front and top of another embodiment of a clamping jaw of the invention.

Figure 11:
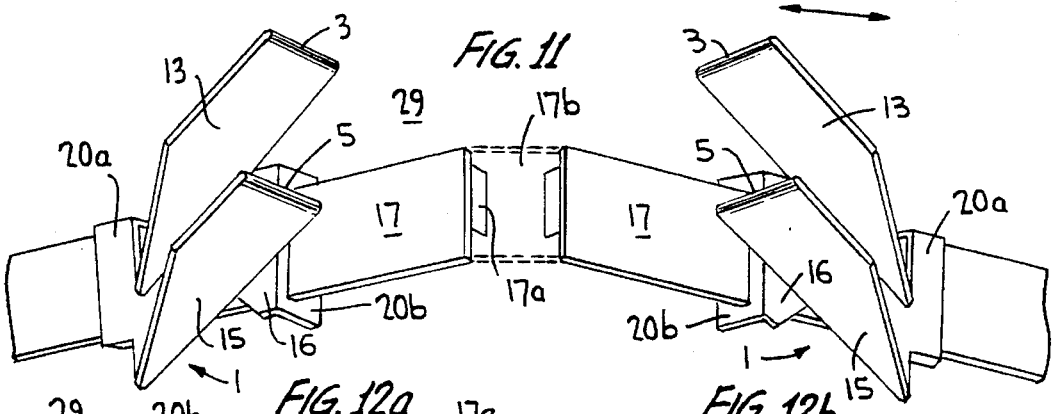
FIG. 11 is a schematic front perspective of another embodiment of a rail-fitted base plate to receive a clamp similar to those of FIGS. 8 and 9.
Figure 12A:
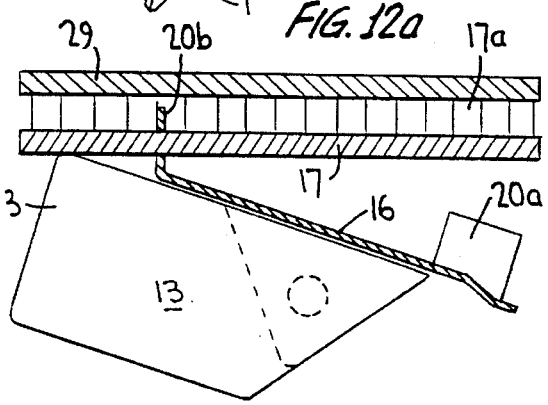
Figure 12B:
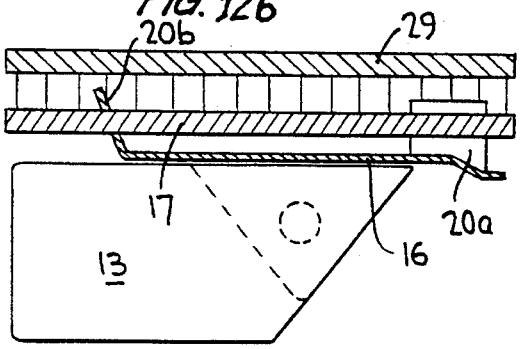

FIGS. 12*a* and 12*b* schematically show a clamping jaw of the clamp of FIG. 11 in the rail-fitted base plate in a longitudinally displaceable and in an affixed state respectively.

Figure 13A:
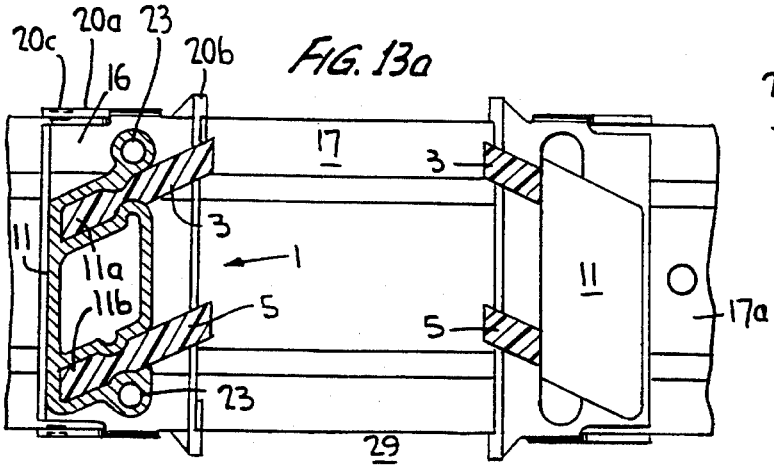
Figure 13B:
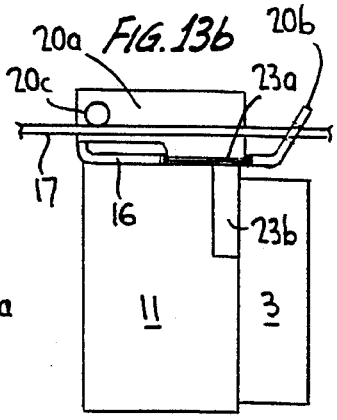

FIGS. 13*a* and 13*b* are, respectively, front and top views of another embodiment of a clamp suitable for continuous longitudinal displacement along a rail-fitted base plate.

Figures 14A, 14B, 15A, 15B, 15C:
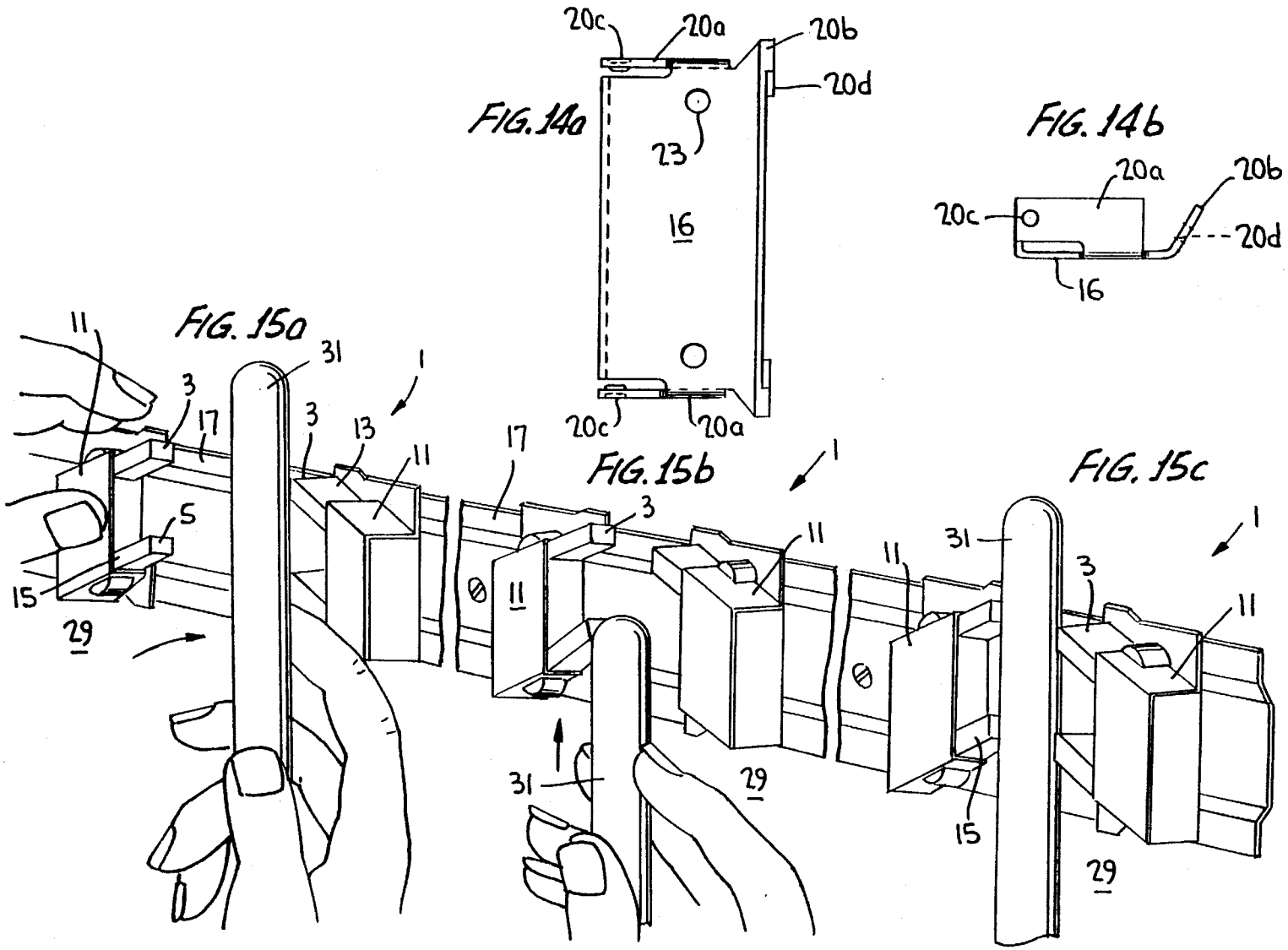

FIGS. 14*a* and 14*b*, respectively, show a front view and a top view of a guide plate of the clamp of FIGS. 13*a* and 13*b*, the guide plate allowing continuous longitudinal displaceability of the clamp.

FIGS. 15*a*, 15*b* and 15*c* schematically show the seating of the clamp of FIGS. 13*a* and 13*b* on the rail-fitted base plate and the clamping of an object between the clamp.

FIG. 16 is a schematic front view of objects of different thicknesses or dimensions mounted on a rail-fitted base plate comprising several clamps as shown in FIGS. 13*a* and 13*b*.

FIGS. 17*a* and 17*b* show a perspective and a top view, respectively, of another embodiment of, respectively, a guide and a base plate suitable for the continuous longitudinal displacement of a clamp.

Figure 1:
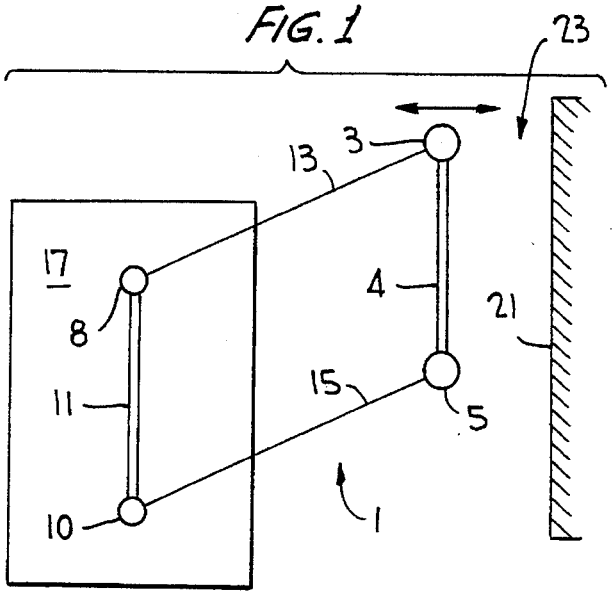

FIG. 1 is a schematic front top view of a clamp of the invention comprising on one hand a clamping jaw 1 and on the other hand an opposite wall or rest surface 21. The jaw 1 is pivotable toward the rest surface in order to clamp a substantially elongated object, such as a broom stick, a garden hoe or a pair of skis, in the intermediary space 23.

The clamping jaw 1 of the invention comprises two longitudinal segments 3 and 5 pointing at their front toward the wall 21 and parallel to the wall 21, i.e., running essentially perpendicularly and in a substantially elongated manner toward a base plate 17 mounted behind the clamping jaw 1. The two segments 3 and 5 are connected, for example, by a web or connection surface or sidewall 4. Moreover, the clamping jaw 1 comprises a sidewall 11 opposite the sidewall 4 and, preferably, rigidly affixed to the rearward base plate 17. Connections, such as hinges 8 and 10, to the two further wall surfaces 13 and 15 are present laterally at the wall 11 whereby the clamping jaw 1 assumes a parallelogrammmic shape. Both the clamping jaw 1 and the wall 21 can be rigidly affixed by means of the base plate 17 to a wall to the rear. In order to firmly mount an object, the object is first inserted by an upward motion into the intermediate space 23 between the clamping jaw 1 and the wall 21 whereby the clamping jaw is driven upward. Then, the object to be clamped is let go so that, by its own weight and because of the friction at the two segments 3 and 5, the object is driven by the clamping jaw 1 against the wall 21 and thus is kept pressed in place.

In the invention, the clamping jaw 1 either comprises two segments 3 and 5 to clamp the object, or only one planar rest surface such as the wall 4 when the two segments 3 and 5 are not projecting. The two segments or the flat surface reliably preclude leaning of the suspended object while nevertheless objects of substantial weights can be hung up in a problem-free manner without slipping between the clamping jaw and the wall.

Figure 2:
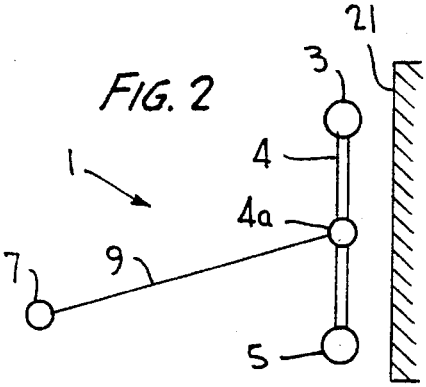

FIG. 2 is another front top view of a further embodiment of a clamping jaw of the invention. In this embodiment the two front segments 3 and 5 or the wall 4 are linked by a central hinge 4*a* and by a web or a wall 9 to a pivot shaft 7. Again, an object is firmly fixed in place between the two segments 3 and 5 or the wall 4 on one hand and the opposite wall 21 on the other hand.

Figure 3:
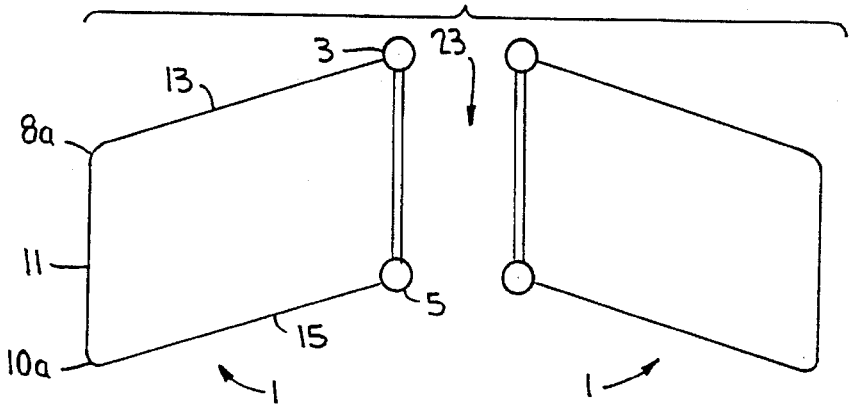
FIG. 3 is a view from the front and top of another clamp comprising two mutually pivotable clamping jaws.

FIG. 3 shows a preferred embodiment of the clamp of the invention wherein two mutually oppositely mounted clamping jaws 1 are surface-symmetrical relative to the central "clamping surface". The same elements as in FIGS. 1 and 2 are denoted herein also by the same references. However, unlike FIG. 1, the rearward wall 11 now lacks terminal hinges or rotary shafts. Instead, the wall 11 in each case is enclosed in an arcuate manner by a flexible material in order that the opposite wall is imparted with some pivotability or rotatability at the two shaft points 8*a* and 10*a*. Quite generally, the two clamping jaws 1 of FIG. 3 can be made of a flexible or elastic material, for example iron sheet metal or a flexible or elastic plastic, whereby the clamping jaws automatically evince some pivotability at the points 8*a* and 10*a*. Obviously the use of a flexible or elastic material also allows for the easy bending upward of the two mutually opposite wall or lateral surfaces 13 and 15. In order to suspend an object to be clamped, for example a pair of skis, the skis first are inserted upward as before between the two clamping jaws and then are let go whereby the two clamping jaws 1 are driven toward each other.

Figure 4:
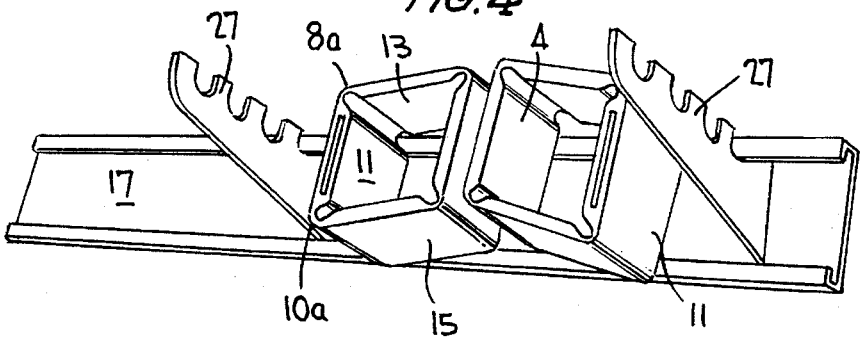
FIG. 4 is a front side perspective of a further embodiment of a clamp comprising two mutually pivotable clamps and holders to mount implements.

In similarity with FIG. 3, FIG. 4 shows two identical and mutually surface-symmetrical clamping jaws mounted on a wall 4, illustratively serving to hang up a pair of skis. Holders 27 are mounted on either side of the clamping jaws 1. A pair of ski poles can additionally be affixed.

Figure 5:
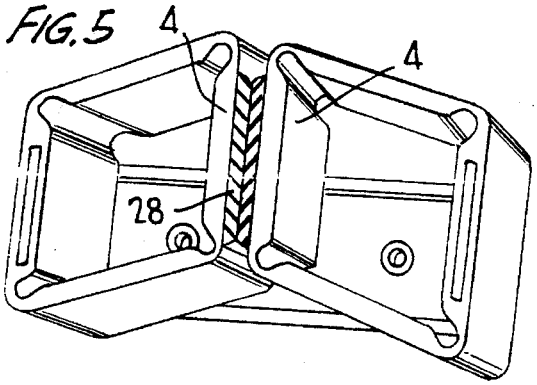
FIG. 5 shows the clamping jaws of FIG. 4 each fitted with a coating to increase sliding friction.

In order to further enhance the holding action between two clamping jaws 1, an additional and where desired toughened rubber coating 28 can be provided along the two front side wall 4 as shown in FIG. 5. Obviously, a corresponding polymer, for example a silicone, polyurethane or similar material, also can be used instead of a rubbery material when coating the two walls 4.

Figure 6:
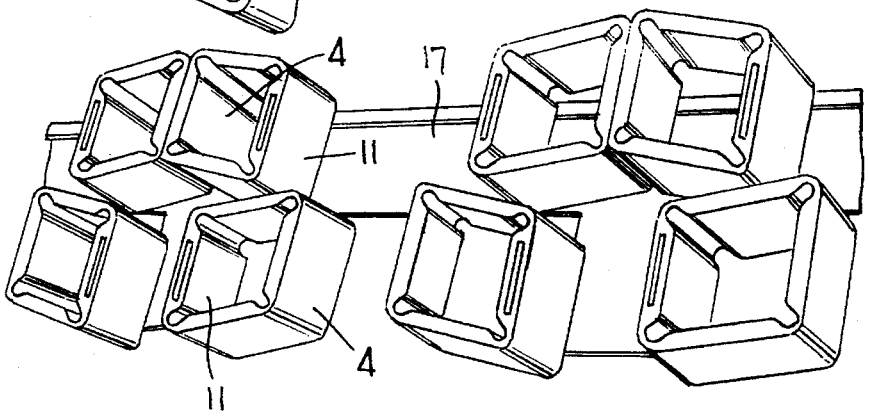
FIG. 6 shows a plurality of clamping jaws of FIGS. 4 and 5.

In order to suspend as many objects as possible from and along one base plate 17, several clamps are used as suggested in the schematic and perspective manner of FIG. 6. The clamping jaws of the invention are then mounted in two distinct and spaced horizontal planes. The configuration of FIG. 6 involves placing clamping jaws for thinner objects in the upper horizontal plane, and spacing the clamping jaws in the lower horizontal plane substantially farther apart. The latter clamping jaws, accordingly, are suitable for hanging up wider or thicker objects.

Figure 7:
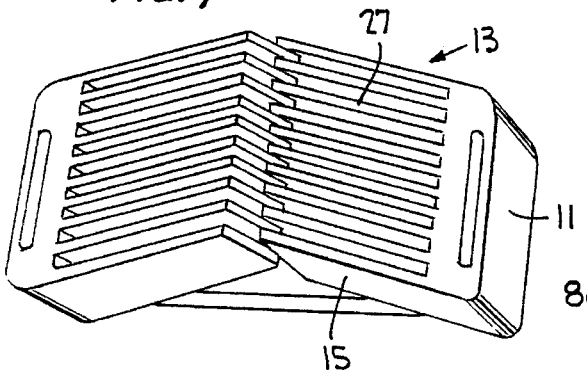
FIG. 7 is a front perspective of another embodiment of a clamp.

FIG. 7 shows another embodiment of a device of the invention comprising two mutually opposite clamping jaws. In the present case, further laminar or web-like elements 27 are mounted between the two side surfaces 13 and 15 and are of the same length as the side surfaces. As a result, a plurality of retaining segments are achieved at the front to hold an object to be placed between the clamping jaws. Such a design can be advantageous for example when the object to be placed between the two clamping jaws evinces roughened surfaces that would adhere only inadequately to planar clamping jaws.

Figure 8:
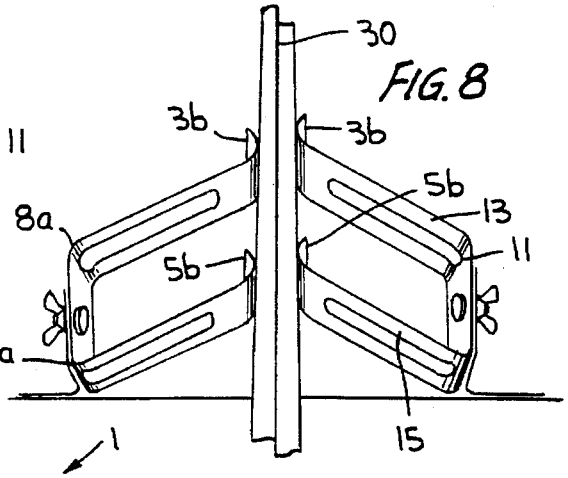
FIG. 8 is a front perspective of another embodiment comprising two clamping jaws which are suitable to hold skis.

FIG. 8 shows another preferred embodiment of a clamp of the invention which is especially well suited to hang up a pair of skis. In the clamp of FIG. 8, the front clamp segments are no longer connected by a rest surface and, thereby, the segments are able to match even closer the outer contours of the object to be held between them. In particular for skis, 30 of which the thickness decreases from the binding to the front point, the front segments advantageously should be mounted in a nearly freely pivoting manner about the wall 11 in order to better match the varying ski thickness. Furthermore, the edge-shaped rest segments so produced in the embodiment mode of FIG. 8 are additionally bent upward to form thereby nearly semi-circular wall segments 3*b* and 5*b*. These wall segments, illustratively, can be additionally coated with a rubber material or a plastic, again, to increase friction and thus to retain heavier objects. Again the clamping jaws, i.e., the clamp of FIG. 8, can be made either of metal, for example iron sheet metal, or of a plastic, for example polyamides, thermoplastic polyesters, PVCs, polyethylenes, and the like. It is essential that the material provide adequate flexibility and not break when the clamp is being bent upward when mounting the object in the two shaft points 8*a* or 10*a* or along the side surfaces 13 or 15.

Figure 9:
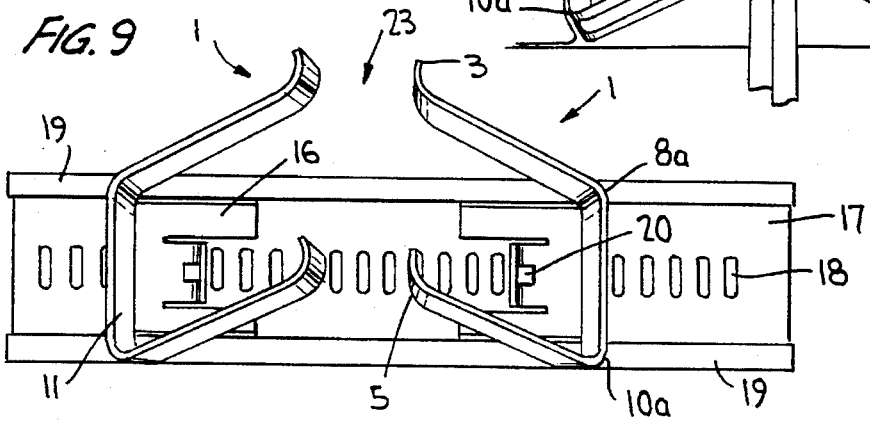
FIG. 9 is the clamp of FIG. 8 mounted on a rail-fitted base plate with several detent pawls.

FIG. 9 shows a clamp similarly mounted to that of FIG. 8 on a rail-fitted base plate 17 and comprising several longitudinal catches 18 and two longitudinal rails 19 holding in a longitudinally displaceable manner two clamping jaws 1. In order to rigidly affix the two clamping jaws, the jaws are fitted with detent pawls 20 which are able to enter the catches 18. To longitudinally displace the two clamping jaws along the two rails 19, they are fitted with guides 16 which in turn are rigidly connected to the two terminal walls 11.

Figure 10:
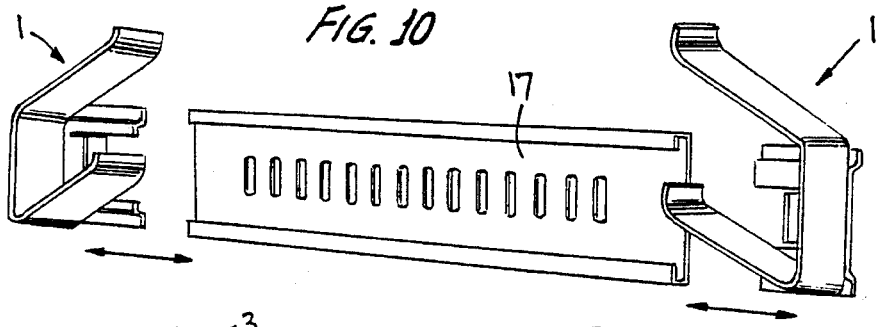
FIG. 10 shows the base plate of FIG. 9 and the two clamping jaws when pulled out.

FIG. 10 is the configuration of FIG. 9 seen in an exploded, front side perspective for better illustration of how the longitudinal displaceability of the clamping jaws along the base plate 17 can be implemented in the shown directions. Using the clamp of FIGS. 9 and 10, narrow objects, such as a broom, a spade or a pair of skis, can be hung up as well as wide or thick objects such as a snowboard. The advantage of such a system is that both skis and snowboards can be hung up simultaneously in a conventional "ski rake" without the need for different devices to accommodate different sports implements. The same advantage of course also applies to hanging up household implements, tools, garden implements and the like.

Similarly to FIGS. 9 and 10, FIG. 11 shows a clamp which is longitudinally displaceable and affixable along a rail-fitted base plate 17. The device of FIG. 11 comprises the two clamping jaws 1 with each including the two flexible, longitudinal walls 13 and 15 provided to press in place between them an object, such as a pair of skis. The two clamping jaws 1 are mounted on a longitudinal, rail-fitted base plate 17 which is graphically interrupted at the center for better clarity. The two rail segments are linked pictorially in dashed manner by the gap 17*b* while in fact they are joined together. Moreover, the two clamping jaws 1 are seen from the middle in FIG. 11 in a different perspective whereas in reality the complete base plate 17 runs as a straight line. Furthermore, the rail-fitted base plate 17 is affixed by a rear tab 17*a* to a rear wall 29.

The two clamping jaws 1 again are mounted analogously to the configuration of FIGS. 9 and 10 on a guide plate 16 comprising a front guide tab 20*b* in each case enclosing the rail 19 at the top and at the bottom in order to keep the guide 16 longitudinally displaceable along the base plate 17.

As shown by FIGS. 12*a* and 12*b*, this guide tab 20*b* subtends at an angle relative to the guide 16. The significance of this angle being discussed further in relation to FIGS. 12*a* and 12*b*. Moreover, the guide 16 each time comprises a rear retaining tab 20*a* to rigidly affix the guide 16 to the rail-fitted base plate 17.

The operation of the device, namely of the plate 16, is elucidated in relation to FIGS. 12*a* and 12*b*, respectively. In FIG. 12*a*, the retaining tab 20*a* is pivoted away from the base plate 17, whereby the guide tab 20*b* is arranged essentially perpendicularly to the plate 17. As a result, the diameter of the guide slot in the guide tab 20*b* is enlarged and, accordingly, the clamping jaw is longitudinally displaceable along the plate 17. Illustratively, the clamping jaw is displaced toward the other clamping jaw of the clamp 1, or away from it, depending on the size of the object to be held between them.

In order to rigidly affix the clamping jaw to the plate 17, the retaining tab 20*a* next is slipped onto the plate 17 and, because of the clamp-like design of the retaining tab 20*a*, it can be firmly anchored into the plate. Now it is seen that the guide tab 20*b* is at an angle relative to the plate 17 and as a result again a clamping effect is achieved in the vicinity of the guide tab. The guide slot in the guide tab 20*b* is made smaller relative to the base rail 17 because of the oblique configuration. Accordingly, even in the presence of comparatively large forces, the centrally present object to be hung up prevents the clamping jaw from being longitudinally displaced. In order to loosen the clamping jaw again, the retaining tab 20*a* is raised from the base plate 17, whereby the clamping of the guide segment 20*b* also is eliminated.

A further embodiment of the clamping jaws 1 is shown in FIGS. 13*a* and 13*b*, the former showing a front view of two associated clamping jaws 1, and the latter showing a top view of one of the two clamping jaws. The clamping jaws 1 shown in FIGS. 13*a* and 13*b* are suitable similar to those shown in FIGS. 11, 12*a* and 12*b* to be continuously displaced along a rail base plate 17. The clamping jaws comprise a rear retaining body 111, two legs 13 and 15 being mounted in retaining slots 11*a* and 11*b* of the body 11 and the legs evincing at the front the strip-shaped segments 3 and 5 of the invention to hold an object between the two clamping jaws. Illustratively, these two legs 13 and 15 are made of a rubber-elastic material, as a result of which the two legs can be slightly deflected upward when inserting from below the object to be hung up. The object when let go is clamped in place again by pivoting downward both legs 13 and 15.

In similarity with the clamping jaws of FIGS. 11, 12*a* and 12*b*, those of FIGS. 13*a* and 13*b* each comprise a guide plate 16 on which the retaining body 111 is affixed for instance by screws 123. As in particular shown by FIG. 13*b*, a screw 123*a* can be screwed into a seat 123*b* at the retainer body 111. Again, the guide plate 16 comprises each time a guide tab 20*b* and a rear retaining tab 20*a* comprising an affixing detent pawl 20*c* to snap the plate 16 into the base plate 17. The clamping jaws are longitudinally displaced in the manner of FIG. 12*a* by the retaining tab 20*a* being pivoted away from the plate 17 by raising the holder detent 20*c* above the rail edge. In the process, the guide plate is pivoted so far away until the guide tab 20*b* is substantially perpendicular to the plate 17 whereby the clamping jaw now can be displaced longitudinally.

FIGS. 14*a* and 14*b* are cutaways, respectively, of a front view and top view of the guide plate 16. The clamp itself is omitted. In FIGS. 14*a* and 14*b*, the guide slot present in the guide tab 20*b* is denoted as 20*d*.

FIGS. 15*a*, 15*b* and 15*c* schematically show how first the two clamping jaws are moved in the proper position to hang up, for example, a bar-shaped object, and then the object itself is suspended.

In FIG. 15*a*, the object 31 is placed against the two legs 13 and 15 of one clamping jaw 1 and is retained there while the other clamping jaw 1 is displaced toward the object to be affixed by pivoting away the guide plate. The latter clamping jaw is displaced toward the object 31 until said object rests firmly against each of the two legs 13 and 15.

In FIG. 15*b*, the object is next displaced from below and upward in the direction of the arrow between the two clamping jaws. The two legs 13 and 15 also are deflected upward on account of their rubber-elasticity.

As shown by FIG. 15*c*, the object 31 is released and as a result it is lowered by its own weight, and at the same time, the two legs 13 and 15 also are driven downward on account of their rubber-elasticity until the object 31 is firmly clamped between the two legs 13 and 15. FIG. 15*c* makes it plain that because of the double clamping of the object 31 between the two legs 13 on one hand and between the two legs 15 on the other hand, leaning or tipping is impossible.

FIG. 16 shows again a front top view of a base rail 17 mounted to a wall 29 and comprising several clamps or clamping jaws of the invention. FIG. 16 clearly shows that various objects of different dimensions, i.e., thicknesses, can be mounted on account of the continuous, sideways longitudinal displacement of the clamping jaws. Illustratively, a comparatively thick or wide board can be mounted, or a pair of skis hung up, or a pipe can be fastened, or the like. Obviously, too, depending on the depth of the object, where called for the clamping jaws of the invention also must evince a larger depth. Illustratively, the clamping jaws shown in FIGS. 13 and 14 can be designed for depths of 5 cm, 10 cm or more.

Another embodiment of a guide or bottom plate 16 is shown in FIGS. 17*a* and 17*b* but not showing the clamp to be mounted on the plate. The plate is again provided to continuously displace a clamping jaw along a base rail 17. FIG. 17*a* shows this embodiment in perspective, seen from the front, whereas FIG. 17*b* is a top view of the guide plate.

Once again the guide or bottom plate 16 is held on the longitudinal rail 17 by the rear retaining-tab 20*a* and the guide tab 20*b*. The displaceability or affixability of the guide plate 16 is implemented by a key 41 which can be inserted through an aperture 43 of the guide plate 16. As shown in an especially clear manner by FIG. 17*b*, the key 41 can be pivoted from an open position to a closed position. The key nature of the key 41 is shown in FIG. 17*b* and allows for rigidly affixing the guide plate 16 either to the rail 17 or the release of the plate.

As a result, the guide or bottom plate 16 is displaceable on the rail 17 when the key is open, whereas after pivoting the key 41, the guide plate 16 is rigidly affixed to the rail 17. The advantage of this guide plate 16 is that the tipping or pivoting motion of the guide plate 16 of FIGS. 13*a* and 13*b* is eliminated. Thereby the distance between the two clamping jaws when pivoting back the clamping jaw to be clamped will reliably not be enlarged when fastening the clamping jaws to an object to be hung up.

The illustratively shown clamps of FIGS. 1 through 17 serve solely to elucidate the invention and obviously can be modified arbitrarily or supplemented. It is trivial, furthermore, whether the devices of the invention are made of a metal or of a plastic. Again, the invention is not restricted to clamping jaws comprising only two rest segments or one surface, but rather and in particular as shown in FIG. 7, such clamping jaws also can evince several segments to clamp objects. Furthermore, several clamping jaws can be mounted in a horizontally superposed manner to make possible reliable and clamped retention of heavy objects.

It is essential for the invention that at least one clamp, or clamping jaw, be provided which comprises at least two clamping segments or one flat clamping surface.

It is claimed:

1. A device for suspending a substantially elongated object comprising at least one clamp directed toward a support or a further clamp such that the object's own weight firmly affixes the object between said at least one clamp and said support or said at least one clamp and said further clamp, wherein said at least one clamp comprises at least two mutually vertically spaced rest segments or at least one planar surface which engage one vertical side of the object being suspended in said device and forces the object against the support or the further clamp, and furthermore wherein said at least one clamp is pivotally mounted in such a manner that said at least two rest segments or said at least one vertical planar surface are pivotable about two connection points such that each rest segment is pivotable about a particular connection point or the planar surface is pivotable in a parallelogramic manner about two connection points, whereby a curved downward motion towards the support or the further clamp affixes the object.

2. Device according to claim 1 wherein said at least one clamp is mounted in a substantially pivotable manner relative to the support or the further clamp.

3. Device according to claim 1 or claim 2 wherein the at least one clamp is a clamping jaw wherein the rest segments form the jaw in conjunction with the planar surface which is essentially parallel to the support or is positioned relative to the further clamp.

4. System to suspend substantially elongated objects of different thicknesses comprising one or more devices according to claim 1 or claim 2 wherein the at least one clamp is detachably affixed in a laterally displaceful manner on a planar base component for mounting in an affixed manner objects of different thicknesses.

5. System according to claim 4 wherein the at least one clamp is mounted on a guide plate, said guide plate comprising at least one tab enclosing at least a top portion of the planar base component, and retaining means offset from the further clamp in a longitudinal direction for detachably affixing the guide plate to the planar base component.

6. System according to claim 5 wherein the at least one tab extends at an angle to guide rails present in the planar base component, guide slots being provided in the at least one tab for the guide rails and having dimensions such that when the guide plate is loosened and pivoted away and when the at least one tab is mounted substantially perpendicular to the guide rails, the guide plate is freely displaceable along the planar base component, said guide rails being at least substantially clamped in the guide slots when the guide plate is rigidly affixed by a retaining means to the planar base component.

7. System according to claim 5 wherein the retaining means comprises a key which detachably affixes the guide plate to the planar base component.

8. Device according to claim 1 wherein one longitudinal dimension of the at least two rest segments or the planar surface is substantially perpendicular to a planar base component.

9. Device according to claim 1 wherein the further clamp comprises at least one rest segment which is pointed, elongated or planar and at which the object to be suspended can be forced by the at least one clamp.

10. Device according to claim 1 wherein the at least one clamp is a parallelogramic clamping jaw wherein one side is rigidly affixed to a planar base component and wherein said clamping jaw is movable laterally parallel and pivotable toward the support and the further clamp to thereby clamp the object.

11. Device according to claim 10 wherein the clamping jaw is a frontally open, substantially U-shaped clamp comprising two mutually parallel, terminal and strip-like segments extending substantially perpendicular to the support.

12. Device according to claim 11 wherein the strip-like segments are bent upwards so that each forms a wall bent in a manner of a clamping jaw, and wherein each wall when in a non-clamping state is substantially vertical one above the other.

13. Device according to claim 11 or claim 12 wherein the substantially U-shaped clamp comprises a rear holder made of a rigid material containing two U-legs, said two U-legs being made of a flexible material which imparts pivotability toward or away from the further clamp to the two strip-like segments which are mounted terminally to said U-legs.

14. Device according to claim 1 wherein the clamp is made at least in part of a flexible material.

15. Device according to claim 1 wherein the rest segments or the planar surface are at least partially roughened or coated with a friction reducing material.

16. Device according to claim 1 wherein the further clamp is substantially surface symmetrical relative to the at least one clamp and is mounted opposite the at least one clamp, and wherein the at least one clamp and the further clamp are mutually pivotable.

17. Device according to claim 1 wherein several of said at least one clamp are present in a vertical array positioned opposite said support or a similar number of other clamps.

* * * * *